United States Patent [19]

Mohacsi et al.

[11] 4,308,800

[45] Jan. 5, 1982

[54] RAIL VEHICLE FOR THE TRANSPORT OF HEAVY AND/OR BULKY GOODS

[75] Inventors: Sandor Mohácsi, Nuremberg; Rudolf Fischer, Ammerndorf; Anton Raschl, Nuremberg, all of Fed. Rep. of Germany

[73] Assignee: Maschinenfabrik Augsburg-Nürnberg Aktiengesellschaft, Nuremberg, Fed. Rep. of Germany

[21] Appl. No.: 959,881

[22] Filed: Nov. 13, 1978

[30] Foreign Application Priority Data

Nov. 11, 1977 [DE] Fed. Rep. of Germany ..... 2750412

[51] Int. Cl.[3] ..... B61F 1/00; B61F 11/00; B61F 13/00

[52] U.S. Cl. ..... 105/159; 410/44; 410/53

[58] Field of Search ..... 105/159; 410/44–53

[56] References Cited

U.S. PATENT DOCUMENTS

| | | | |
|---|---|---|---|
| 1,903,841 | 4/1933 | Spoor | 105/367 |
| 2,812,727 | 11/1957 | Dorsey | 105/367 |
| 3,237,786 | 3/1966 | Milliken | 105/367 |

FOREIGN PATENT DOCUMENTS

| | | | |
|---|---|---|---|
| 1180391 | 10/1964 | Fed. Rep. of Germany | 105/159 |

*Primary Examiner*—Richard A. Bertson

*Attorney, Agent, or Firm*—Becker & Becker, Inc.

[57] ABSTRACT

A rail vehicle for the transport of heavy and/or bulky goods with one multi-axle driving mechanism each. The driving mechanisms are respectively arranged on both ends of said rail vehicle. The rail vehicle furthermore includes at least one bridge girder interconnecting the bogies at each end of said rail vehicle. Pivotally mounted on said at least one bridge girder by means of an interposed displaceable member is a beak of a loading bridge supported by said driving mechanisms. The displaceable member with a displacing device facing the vehicle end infinitely variably displaceably and/or arrestably is connected to the bridge girder. The displacing device which faces toward the central portion of the vehicle rigidly or movably connects the displaceable member by way of a pivot point or bolt fixedly guided on the beak to the beak which is rotatable about a joint. The two displacing devices are adapted by a controlling device to be controlled in conformity with each other.

6 Claims, 8 Drawing Figures

RAIL VEHICLE FOR THE TRANSPORT OF HEAVY AND/OR BULKY GOODS

The present invention relates to a rail vehicle for the transport of heavy and/or bulky goods with one driving mechanism each at each end of the rail vehicle and comprising a plurality of multi-axle bogies. More specifically, the present invention relates to a rail vehicle of the just mentioned type which is provided with at least one bridge beam each which interconnects the bogies at each end of the rail vehicle, and on which by means of an interposed displaceable beam (Verschubträger) there is pivotally journalled a beak of a loading bridge supported by the driving mechanisms.

The present invention aims at creating a rail vehicle which is suited for the transport of heavy and/or bulky goods and which, even at a high speed, can drive through curves without time consuming manual manipulations, especially with regard to the actuation of links or joints of a loading bridge.

Rail vehicles of the above described type are known in which between the beak of a loading bridge and the bridge beam interconnecting the bogies having a plurality of axles, there is arranged a segment-shaped beam which is displaceably mounted about a pivot facing the center of the vehicle. The displaceable beam is moved by a cylinder piston drive which is pivotally arranged on the displaceable beam and on the bridge beam while preferably extending at an incline to the longitudinal central plane of the rail vehicle. The cylinder piston drive is adapted to be arrested after an effected movement. In this connection the beam rests through a rotatable plate or bearing socket (Drehpfanne) on the displaceable beam. Moreover, between the rotatable plate and the pivot point of the displaceable beam within the region of the longitudinal central plane there is arranged a vertical spindle which by an axial displacement makes possible that the beak and the displaceable beam form a positive unit so that, when the cylinder piston drive is relieved, the pivot point of the displaceable beam becomes the pivot point proper. When the spindle is pulled up and the cylinder piston drive is arrested, the rotatable plate of the beak can form the pivot point. While with this device disclosed in German Pat. No. 11 80 391 it is possible, when driving through curves, also through curves with a short radius, to change from an inner to an outer pivot point, it is necessary to manually move the spindle upwardly and downwardly. This prevents a continuous and prompt passing through curves.

It is, therefore, an object of the present invention to provide a rail vehicle for the transport of heavy and/or bulky goods which will make it possible without manual action in the operating cycle of the pivot points of the beaks to drive through curves of different radii in a continuous manner and also at high speeds.

This object and other objects and advantages of the invention will appear more clearly from the following specification in connection with the accompanying drawings, in which.

Figure 1:
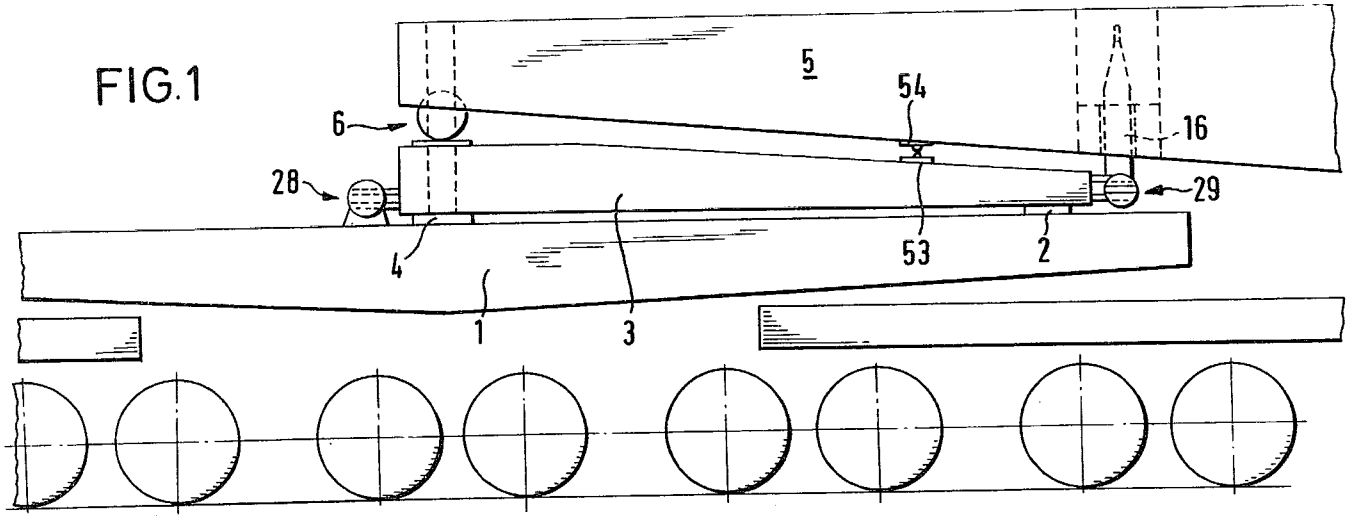
FIG. 1 is a side view of a rail vehicle, only partially shown, with the pivot points provided at one end of the rail vehicle for a beak of a loading bridge.

The rail vehicle according to the present invention is characterized primarily in that the displaceable beam is by means of a displacing device facing the end of the vehicle infinitely displaceably and/or adjustably connected to the bridge beam. The invention is furthermore characterized in that the displacing device facing the center of the vehicle connects the displaceable beam rigidly or movably with the beak rotatable about the joint through the intervention of a pivot point firmly guided on the beak, the displaceing device being adapted to be controlled by means of a control device, while the displacing device and the control device are adapted to be controlled in conformity with each other.

The above described arrangement brings about the advantage that without stopping, the rail vehicle can drive through the respective curve at unchanged speed. With heretofore known devices, a driving through a curve was possible only by stopping the vehicle while adjusting the pivot points.

A further development of the invention is characterized in that at least one displacing device, in addition to comprising a known displaceable beam, which is horizontally displaceable about a vertical axis on the bridge beam, also comprises at least one cylinder piston drive located in the region of the longitudinal central plane of the vehicle. Furthermore, the cylinder piston drive which faces the vehicle center is linked to the displaceable beam as well as to a pivot guided on the beak, while the cylinder piston drive which faces the end of the vehicle is linked to the displaceable beam and the bridge beam. Furthermore, these cylinder piston drives are alternately operable and arrestable. This arrangement brings about the advantage that the cylinder piston drive can operate with a hydraulic fluid which is easily controllable by valves. As a result thereof, it is possible, during the driving to shift over from the outer to the inner pivot point and vice versa and to displace the outer pivot point laterally within certain limits.

In order to be able fully automatically to actuate the control device and thereby to exclude any human errors, the present invention is characterized in that the control device comprises two hydromagnetic valves which are arranged in series. These hydromagnetic valves are adapted to be controlled by limit switches forming part of the electric circuit and by an auxiliary relay. The limit switches have two poles and it is possible to establish the connection of one pole of a current supply with the hydromagnetic valve, on the one hand, and by means of contact with a holding contact of the auxiliary relay on the other hand. By means of the second limit switch which likewise has two poles and by means of a contact, a circuit can be closed by the first limit switch and the hydromagmetic valves. By contact of the second limit switch, the auxiliary relay is rendered operative and the auxiliary relay is by means of the holding contact and the contact of the first limit switch held in its operative condition.

Such a control device will assure that the switching from the inner guide to the outer guide, as it is necessary when driving through curves, can be carried out without any action on the part of the operator or operators. Without the circuit according to the present invention for electrically controlling the valves of the cylinder piston drive, a fast reaction and control which exclude human errors would not be possible. A control of the above mentioned type is the sole assurance, without risking major accidents, to pass through curves without reducing the speed.

According to a further development of the invention, the displacing device comprises at least one cable each connected to the ends of the displaceable beam within the region of its longitudinal central plane. Furthermore, one end of this cable is arranged transverse to the driving direction and is connected to that end of the displaceable beam which faces the central portion of the vehicle, whereas the other end of the cable is linked to that side of the displaceable beam which faces the end of the vehicle, the cables respectively being connected to devices actuating the same.

Such a displacing device formed by cables is of a simple construction and low cost. As a result of these properties, the cable construction requires little service. This cable construction assures a great safety against damage because the simple and easily observed construction makes it possible that damage to the cables can easily be noticed by unskilled personnel prior to such damages becoming dangerous.

In order to bring about a displacement of the respective pivot point within a certain region, the invention is characterized by a further feature, namely that the displacing device comprises at least one chain each linked to the ends of the displaceable beam within the region of the longitudinal central plane. Furthermore, the chains are arranged transverse to the driving direction, and one chain is connected to that end of the displaceable beam which faces the central portion of the vehicle, whereas the other chain is linked to that side of the displaceable beam which faces the vehicle end, the chains being respectively connected to a movable device each.

A displacing device which comprises a chain as power transferring means makes possible an easy transfer of the forces from the driving unit to the transferring means because this can be done in a simple way by means of a sprocket wheel.

Referring now to the drawings in detail, a rail vehicle for the transport of heavy and/or bulky goods is formed primarily by driving mechanisms arranged at the vehicle ends and by a loading bridge interposed therebetween, while each driving mechanism comprises a plurality of multi-axle bogies only partly shown in the drawings. The individual bogies are interconnected by a bridge beam 1 forming a bogie connecting frame. The bridge beam 1 is intended uniformly to transfer the load introduced through a beak 5 of the loading bridge onto the bogies. By means of this bridge 1, within the region of its longitudinal central plane and the center of the vehicle, a pivot 2 is fastened about the vertical axis of which a displaceable beam 3 is rotated. The displaceable beam 3, through sliding plates 4, rests with that side thereof which faces the vehicle end on the bridge beam 1 and is displaceable on the bridge beam transverse to the driving direction of the rail vehicle. The displaceable beam 3 serves for absorbing forces which are introduced into the displaceable beam through the intervention of beak 5 of the loading bridge and through a bearing socket 6. The displaceable beam 3 transfers these forces through sliding plates 4 into the bridge beam 1.

For pivoting the displaceable beam 3 about a pivot 2 which interconnects the beam 3 and the bridge beam 1, a displacing device with a hydraulic cylinder piston drive *7a, 7b* is provided on the bridge beam.

The displaceable beam 3 which is rotatable about the pivot 2 and connected to the bridge beam 1 and which is displaceably resting by means of the sliding plates 4 on the bridge beam, is moved at both ends by the hydraulic pistons 8, 9, 10 and 11. That cylinder piston drive *7b* which faces the central portion of the vehicle comprises the hydraulic pistons 8 and 9 arranged symmetrically to the longitudinal axis of the vehicle and transverse to the driving direction, and furthermore comprises the hydraulic cylinder 12 and 13. The hydraulic cylinders 12, 13 are pivotally connected to the beam 3, and the hydraulic pistons 8, 9 are likewise pivotally connected to a bolt 16 which is mounted in the beak 5.

That cylinder piston drive *7a* which faces the vehicle end is arranged likewise symmetrically with regard to the longitudinal plane and transverse to the driving direction. The two hydraulic cylinders 14, 15 are pivotally connected to the bridge beam 1 and the hydraulic pistons 10, 11 are pivotally connected to the beam 3.

As to the circuits for the hydraulic conduits, all spaces of the hydraulic cylinders which are not filled with hydraulic fluid, are through a leakage oil conveying conduit 17 in communication with a supply and compensating container 18. If with inner guide, which means pivoting of the beam 3 about the pivot 2, this pivot is to be the pivot point, by means of a hydromagnetic valve 56 one conduit 20 interconnecting the two chambers of the hydraulic cylinders 12, 13 is shut off, so that the bolt 16 is arrested by means of the hydraulic pistons 8, 9 and beak 5 and beam 3 form a unit rotating about pivot 2. During this operation, the chambers of the hydraulic cylinders 14, 15 which are interconnected by a conduit 21 through an opened hydromagnetic valve 55 are in communication with each other so that the beam 3 which through sliding plates 4 rests upon the bridge beam 1 can be laterally freely displaced.

When shifting from the inner to the outer guide, the hydromagnetic valve 55 in the circuit is closed so that by means of the hydraulic pistons 10, 11 and the pivot 2 the beam 3 forms a unit with the bridge beam 1. In this instance, the pivot point for the beak 5 is formed by the bearing socket 6. The hydraulic cylinders 12, 13 communicate with each other through conduit 20 and the hydromagnetic valve 56 so that the bolt 16 is freely movable.

The switch-over from inner to outer guide is necessary to limit the lateral deviation or pivoting stroke of the beam 3 upon the sliding plate 4. Since otherwise, when driving through a curve, the sliding plates 4 would go beyond the outer contour of the bridge beam 1.

The pivoting of beam 3 is effected by the hydraulic pistons 10 and 11. When the hydromagnetic valve 55 is closed, a pump 24 is controlled by the supply and compensating container 18 through a suction line 23, and through valve 25, hydraulic fluid is conveyed to the hydraulic cylinder 14 or 15 so that the beam 3, while being rotatable about pivot 2, can be displaced transverse to the bridge beam 1 to one or the other side. During this operation, the hydromagnetic valve 56 is opened. In order to compensate for losses of the hydraulic fluid in the hydraulic cylinders 12, 13, a feeding valve 26 is interposed in conduit 20.

Figure 3:
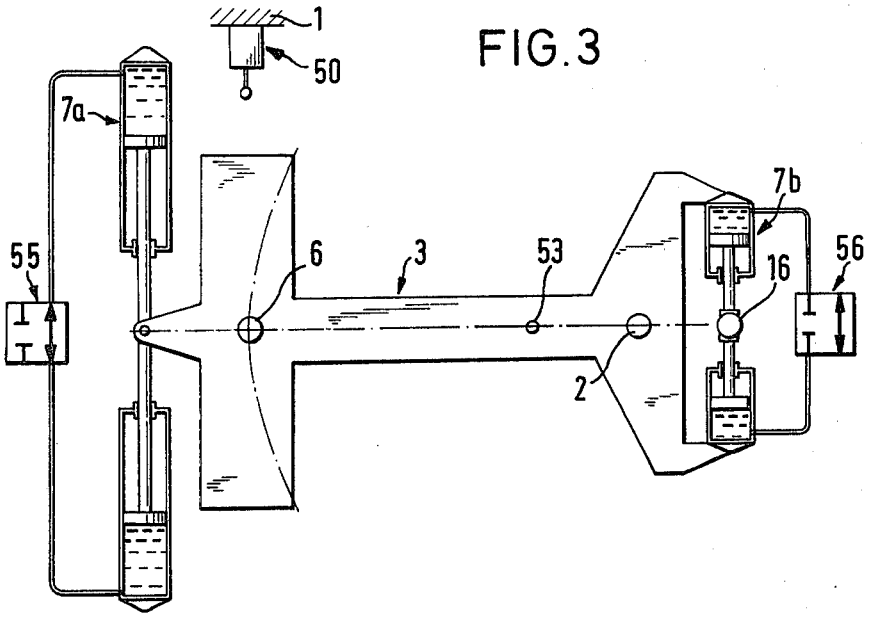
FIG. 3 is a top view of the displaceable beam during straight forward drive, with cylinder piston drive and the two limit switches.
Figure 4:
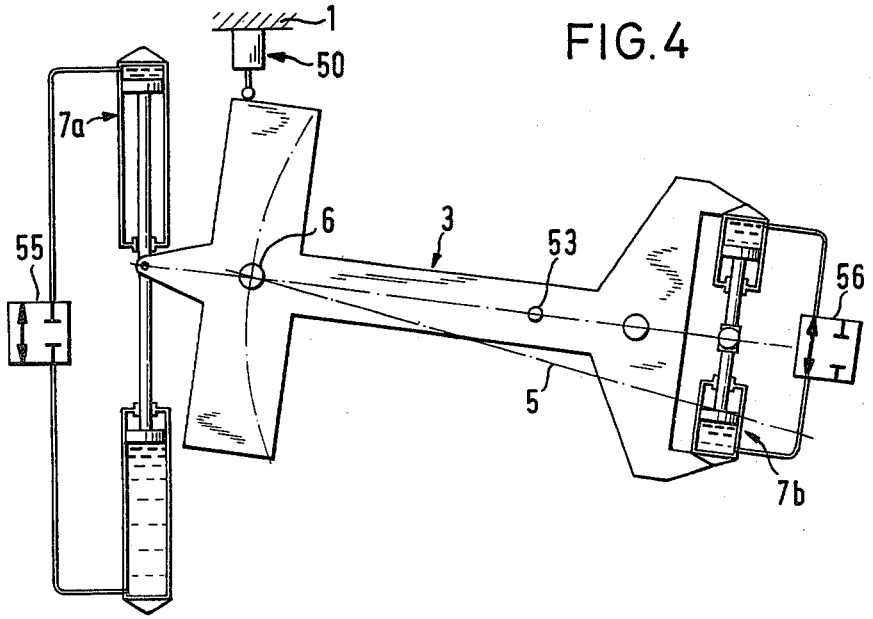
FIG. 4 is a top view of the displaceable beam when driving through a curve in the maximum pivoted condition and with the beak illustrated as center line after the change-over from the inner to the outer guide.

FIGS. 3 and 4 diagrammatically illustrate the position of the displaceable beam 3 with inner and outer guide. This includes the limit switches 50, 53 and the hydromagnetic valves 55, 56 which are adapted to control the cylinder piston drives *7a*, *7b* arranged at both ends of the vehicle.

According to FIG. 3, the beam 3 extends parallel to the longitudinal central plane of the vehicle and is firmly connected to the beak 5 by means of the cylinder piston drive *7b* while being rotatable about pivot 2 relative to the bridge beam 1. In this instance, the inner guide is effective. If now the vehicle enters a curve, the beam 3 rotates relative to the bridge beam 1. In order to prevent the outward turning of the beam 3 beyond an admissible extent, the beam 3 moves against a limit switch 50 connected to the bridge beam 1, which limit switch 50 through a corresponding control device 62 shifts over from the inner guide shown in FIG. 3 to the outer guide shown in FIG. 4.

Figure 2:
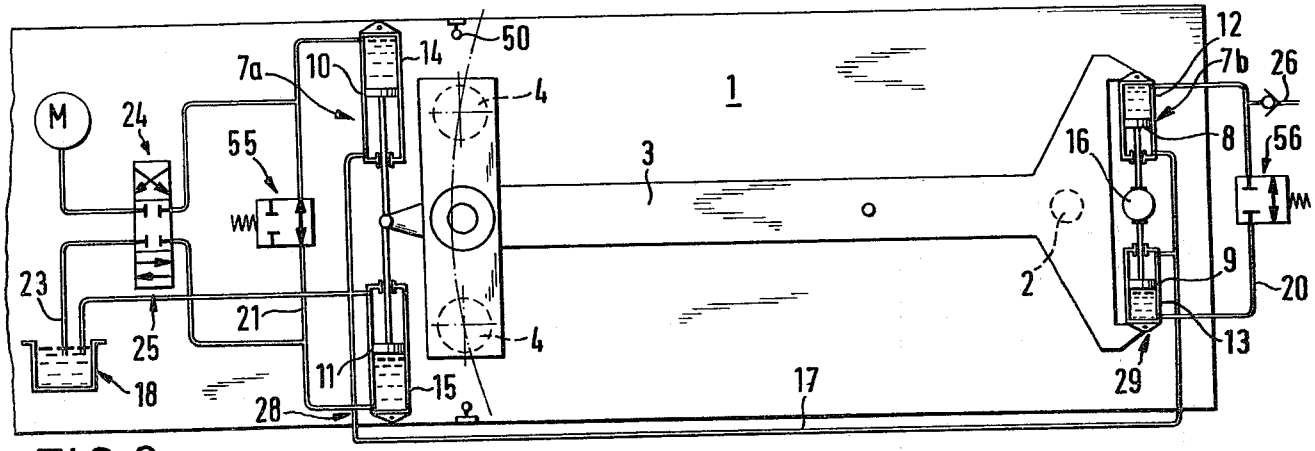
FIG. 2 is a top view of the rail vehicle of FIG. 1 and also shows the displacing device with control circuit for the hydraulic conduits and for the cylinder piston drive, while the beak of the loading bridge has been removed.

FIG. 4 illustrates the beam 3 arrested by the pivot 2 and the cylinder piston drive *7a*, while the beak 5, as evident from FIGS. 1 and 2, rotates about the rotatable pan 6. The shift-over operation will thus be effected through a cooperation of limit switch 50 with a further limit switch 53 arranged on beam 3 in the longitudinal central plane thereof, and by hydromagnetic valves 55, 56 actuating the limit switches. The hydromagnetic valves 55, 56 selectively effect intercommunication between the cylinder chambers of cylinder piston drives *7a*, *7b* or block such communication.

FIGS. 5 to 8 show circuits of the control device 62 as they result from the position of beam 3 and beak 5 relative to each other in conformity with FIGS. 3 and 4.

Figure 5:
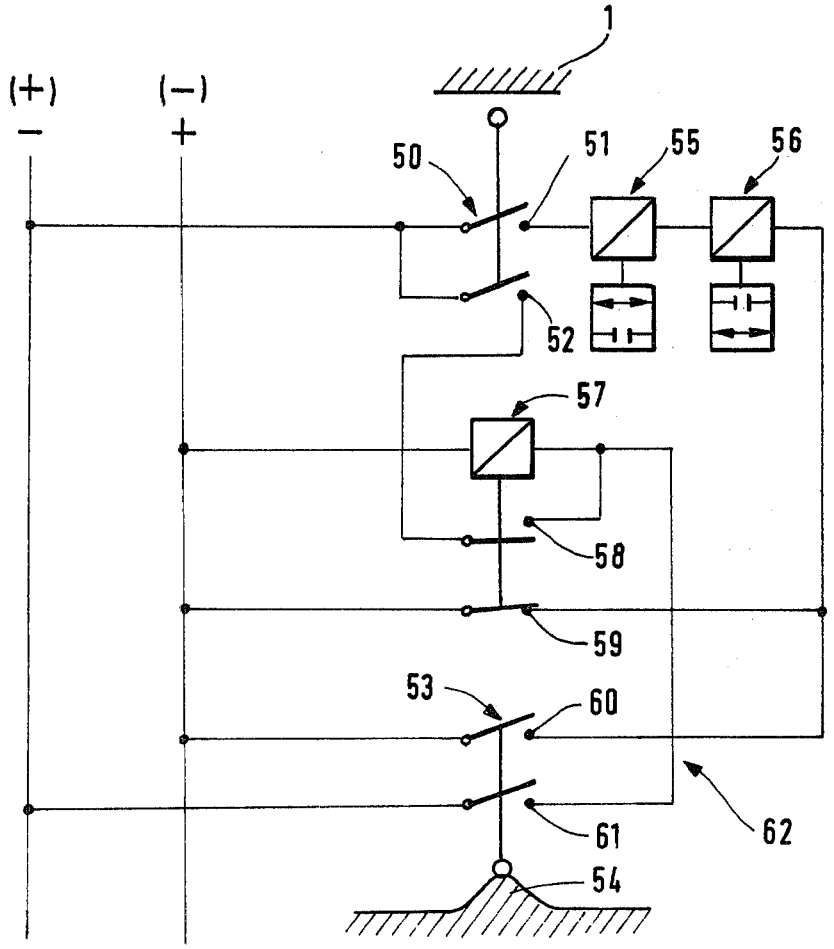
FIG. 5 shows a control circuit of a control device with the position of the limit switches in conformity with straight forward drive and inner guide.
Figure 6:
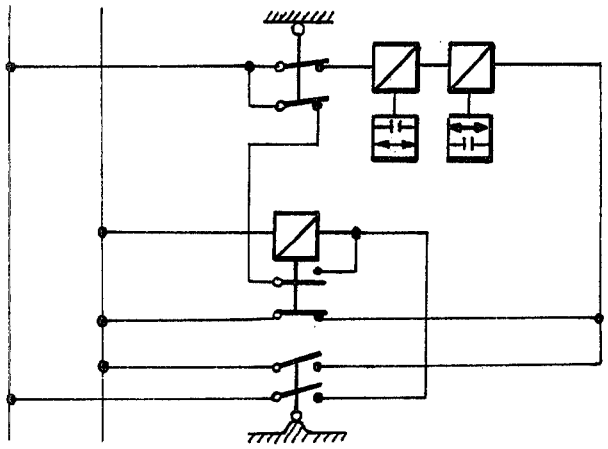
FIG. 6 is a control circuit of the control device when driving through a curve and while changing over from inner guide to outer guide.
Figure 7:
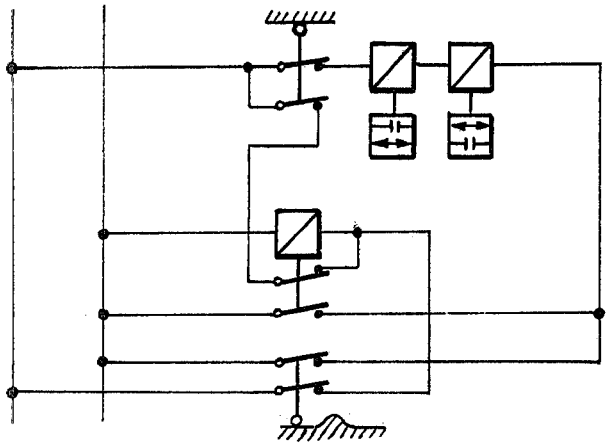
FIG. 7 is a control circuit of the control device while driving through a curve and after the change-over from the inner guide to the outer guide.
Figure 8:
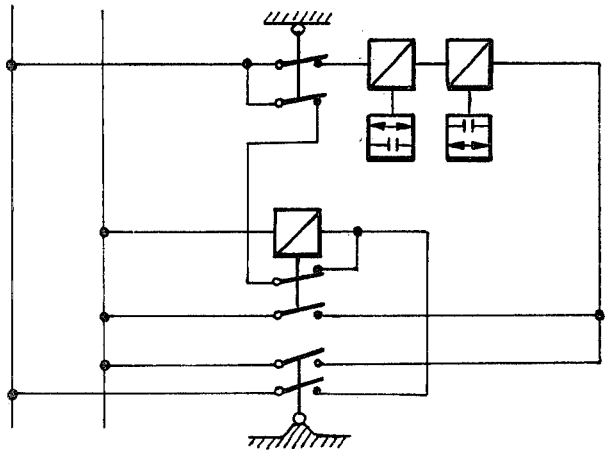
FIG. 8 represents a control circuit of the control device during drive through a curve at the instant of changing over from the outer guide to the inner guide, the displaceable beam and the beak again forming a unit.

According to FIG. 5 both limit switches 50, 53 are opened as results from the position according to FIG. 3. This position corresponds to a straight drive of the vehicle. If the vehicle now enters a curve, the beam 3 is pivoted. When the curve radius becomes too short, the beam 3 would drive beyond the provided confinement of the bridge beam 1. To prevent this from happening, the movement is limited by abutting a limit switch 50 as shown in FIG. 4. When the limit switch 50 is closed, the limit switch 53 is located above the cam 54 and is opened so that the circuit of FIG. 6 is obtained. The circuit from the positive to the negative pole through the limit switch 50, the hydromagnetic valves 55, 56 and the contact 59 of the auxiliary relay 57 is closed. Inasmuch as the hydromagnetic valves 55, 56 are arranged in series, it will be assured that valve 55 will close when valve 45 simultaneously opens. While according to FIG. 4 the cylinder chambers of the cylinder piston drive *7a* are separated from each other by valve 55, it will be appreciated that at the same time by opening valve 56 both cylinder chambers of the cylinder piston drive *7b* are in communication. The result is that the movement of beam 3 is blocked and the turning of beam 5 occurs only about the rotatable plate 6. In other words, the outer guide is effective.

Following the switch-over from inner to outer guide, the beak 5 will with decreasing curve radius move out and the limit switch 53 leaves cam 54 and is closed. The circuit will then be in the position shown in FIG. 7. By closing the switch 53, the contacts of the auxiliary relay 57 are actuated by contact 61 so that the current will flow to the valves 55, 56 only via contact 60 of limit switch 53 and via contact 51 of limit switch 50. When the auxiliary relay 57 is actuated, the circuit is opened through contact 59, and simultaneously the relay is held in its position by holding contact 58 and contact 52 of the limit switch 50.

When the vehicle changes from driving through a curve to straight driving, first a rotation of the beak 5 about the rotatable plate 6 occurs and limit switch 53 rides over cam 54. This brings about an opening of the limit switch 53 and thereby also an opening of the contact 60 which closes the circuit from the source of direct current through the hydromagnetic valves 55, 56. Inversely, when closing the circuit through the hydromagnetic valves 55, 56, valve 55 opens while at the same time, due to the series arrangement, valve 56 closes. As a result thereof, the cylinder piston drive *7b* is blocked, and the cylinder piston drive *7a* is freed. Thus, again the inner guide is effective with a rotation of beam 3 and beak 5 about pivot 2, while beam 3 and beak 5 again form a unit. With the vehicle further moving out of the curve into a straight driving path, beam 3 moves in the direction toward the central longitudinal axis of the vehicle and frees limit switch 50. The current circuit is opened via holding contact 58 and contact 52, the auxiliary relay 57 drops off and the starting position of the circuit is reestablished as shown in FIG. 5.

The poling of the control device 62 in FIGS. 5 to 8 differs from the above mentioned poling of the device 62 but is equivalent to the above poling.

The displacing device has been shown as an electro-hydraulic unit. This, however, does not exclude that instead of the cylinder piston drive *7a*, *7b*, a functionally equivalent displacing device, for instance by means of a cable drive or a chain drive, can be employed. Such means are considered equivalent elements with regard to those described above.

It is, of course, to be understood that the present invention is, in no way, limited to the specific showing in the drawings, but also encompasses any modifications within the scope of the appended claims.

What we claim is:

1. A rail vehicle having a region of a longitudinal central plane and having a vertical axis near an end of the vehicle facing away from the central section for transporting heavy and bulky goods, which includes: drive mechanism respectively arranged at each end of said vehicle, two loading bridges respectively supported by said drive mechanisms, a beak provided with each loading bridge, a joint about which said beak is rotatable, each of said drive mechanisms comprising a plurality of multi-axle bogies, at least two bridge girders respectively interconnecting said bogies at said vehicle ends, each of said at least two bridge girders pivotally supporting one of said beaks through the intervention of a displaceable member, two displacing mechanisms, each of said displacing mechanisms comprising: a first displacing means including a piston-cylinder drive facing one vehicle end and operatively connected to the respective adjacent displaceable member and also comprising a second displacing means including a piston-cylinderdrive facing the respective pertaining central portion of the vehicle, a pivot operatively connecting the pertaining displaceable member to said beak, said pivot being guided on said beak, and electro-hydraulic control means operatively connected to said displacing mechanism for controlling said first and second displacing means including the piston-cylinder drives therewith in conformity with each other and controllable dependent upon each other.

2. A rail vehicle having a region of a longitudinal central plane and having a vertical axis near an end of the vehicle facing away from the central section for transporting heavy and bulky goods, which includes: drive mechanism respectively arranged at each end of said vehicle, two loading bridges respectively supported by said drive mechanisms, a beak provided with each loading bridge, a joint about which said beak is rotatable, each of said drive mechanisms comprising a plurality of multi-axle bogies, at least two bridge girders respectively interconnecting said bogies at said vehicle ends, each of said at least two bridge girders pivotally supporting one of said beaks through the intervention of a displaceable member, two displacing mechanisms, each of said displacing mechanism comprising: a fist displacing means facing one vehicle end and operatively connected to the respective adjacent displaceable member and also comprising a second displacing means facing the respective pertaining central portion of the vehicle, a pivot operatively connecting the pertaining displaceable member to said beak, said pivot being guided on said beak, and control means operatively connected to said displacing mechanism for controlling said first and second displacing means in conformity with each other, said displaceable member being pivotable about a vertical axis near that end thereof which faces away from the central section of said vehicle, at least one of said displacing mechanisms including a cylinder-piston drive arranged within the region of the longitudinal central plane of said vehicle.

3. A vehicle according to claim 2, in which at least one of said displacing mechanisms has its second displacing means designed as a cylinder-piston drive pivotally connected to said displaceable member and also to a pivot point guided on said beak whereas said first displacing means facing toward the pertaining vehicle end is pivotally connected to said displaceable member and said bridge girder, said vehicle also including an electrohydraulic control device operatively connected to said first and second cylinder-piston drives for alternately actuating and arresting the same.

4. A vehicle according to claim 3, in which said control device includes two two-pole hydromagnetic valves arranged in series and having a circuit associated therewith comprising two limit switches and an auxiliary relay for controlling said hydromagnetic valves, one of said limit switches being operable to establish connection between one pole of a current supply and said hydromagnetic valves on one hand and by means of a second contact to establish connection with a holding contact of said auxiliary relay on the other hand, the other one of said limit switches being operable through a first contact so to close a circuit containing said first contact and said first limit switch and said hydromagnetic valves that by a second contact pertaining to said other one limit switch the auxiliary relay is triggered and said auxiliary relay, through said holding contact and said second contact of said one limit switch, is held in its triggered position.

5. A rail vehicle having a region of a longitudinal central plane and having a vertical axis near an end of the vehicle facing away from the central section for transporting heavy and bulky goods, which includes: drive mechanism respectively arranged at each end of said vehicle, two loading bridges respectively supported by said drive mechanisms, a beak provided with each loading bridge, a joint about which said beak is rotatable, each of said drive mechanisms comprising a plurality of multi-axle bogies, at least two bridge girders respectively interconnecting said bogies at said vehicle ends, each of said at least two bridge girders pivotally supporting one of said beaks through the intervention of a displaceable member, two displacing mechanisms, each of said displacing mechanisms comprising: a first displacing means facing one vehicle end and operatively connected to the respective adjacent displaceable member and also comprising a second displacing means facing the respective pertaining central portion of the vehicle, a pivot operatively connecting the pertaining displaceable member to said beak, said pivot being guided on said beak, and control means operatively connected to said displacing mechanism for controlling said first and second displacing means in conformity with each other, said displacing mechanisms including at least two cables respectively connected to the ends of said displaceable member within the region of the longitudinal central plane of said displaceable member, one end of one connected cable extending transverse to the driving direction of said vehicle and being connected to that end of the displaceable member which faces toward the central section of said vehicle whereas the other end of the other cable is pivotally connected to that side of said displaceable member which faces toward the vehicle end, said cables being connected to a device for moving same.

6. A rail vehicle having a region of a longitudinal central plane and having a vertical axis near an end of the vehicle facing away from the central section for transporting heavy and bulky goods, which includes: drive mechanism respectively arranged at each end of said vehicle, two loading bridges respectively supported by said drive mechanisms, a beak provided with each loading bridge, a joint about which said beak is rotatable, each of said drive mechanisms comprising a plurality of multi-axle bogies, at least two bridge girders respectively interconnecting said bogies at said vehicle ends, each of said at least two bridge girders pivotally supporting one of said beaks through the intervention of a displaceable member, two displacing mechanisms, each of said displacing mechanisms comprising: a first displacing means facing one vehicle end and operatively connected to the respective adjacent displaceable member and also comprising a second displacing means facing the respective pertaining central portion of the vehicle, a pivot operatively connecting the pertaining displaceable member to said beak, said pivot being guided on said beak, and control means operatively connected to said displacing mechanism for controlling said first and second displacing means in conformity with each other, said displacing mechanism including at least two chains respectively pivotally connected to the ends of said displaceable member within the region of the longitudinal central plane of said vehicle, said chains extending transverse to the driving direction of said vehicle, one chain being connected to that end of said displaceable member which faces toward the central section of said vehicle, whereas the other chain is pivotally connected to that side of said displaceable member which faces toward the vehicle end, actuating means being provided and connected to said chains for moving the same.

* * * * *